US010171914B2

(12) United States Patent
Zhu et al.

(10) Patent No.: US 10,171,914 B2
(45) Date of Patent: Jan. 1, 2019

(54) VIBRATION SOUND-GENERATING DEVICE

(71) Applicant: GOERTEK INC., Weifang (CN)

(72) Inventors: Yueguang Zhu, Weifang (CN); Chao Wang, Weifang (CN)

(73) Assignee: GOERTEK INC., Weifang (CN)

( * ) Notice: Subject to any disclaimer, the term of this patent is extended or adjusted under 35 U.S.C. 154(b) by 26 days.

(21) Appl. No.: 15/505,609

(22) PCT Filed: Dec. 7, 2015

(86) PCT No.: PCT/CN2015/096597
§ 371 (c)(1),
(2) Date: Feb. 21, 2017

(87) PCT Pub. No.: WO2017/031861
PCT Pub. Date: Mar. 2, 2017

(65) Prior Publication Data

US 2018/0220238 A1 Aug. 2, 2018

(30) Foreign Application Priority Data

Aug. 25, 2015 (CN) ..... 2015 1 0528217

(51) Int. Cl.
*H04R 9/02* (2006.01)
*H04R 9/06* (2006.01)
*H04R 9/04* (2006.01)

(52) U.S. Cl.
CPC ..... *H04R 9/025* (2013.01); *H04R 9/02* (2013.01); *H04R 9/046* (2013.01); *H04R 9/06* (2013.01)

(58) Field of Classification Search
CPC .... H04R 2400/03; H04R 9/025; H04R 9/046; H04R 9/06; H04R 2499/11; H04R 2499/15; H04R 1/025; H04R 3/00
(Continued)

(56) References Cited

U.S. PATENT DOCUMENTS 9,237,390 B2 * 1/2016 Gao ..... H04R 1/028

FOREIGN PATENT DOCUMENTS

| | | | |
|---|---|---|---|
| CN | 201995124 U | | 9/2011 |
| CN | 103067834 A | * | 4/2013 |
| CN | 103067834 A | | 4/2013 |

* cited by examiner

*Primary Examiner* — Sunita Joshi
(74) *Attorney, Agent, or Firm* — Moser Taboada

(57) ABSTRACT

A vibration sound-generating device comprises a housing and a vibration system and a magnetic circuit system received in the housing, a sound exit hole being provided on a side surface of the housing, wherein the vibration system comprises a vibrating diaphragm, a voice coil and a voice coil framework for connecting the vibrating diaphragm with the voice coil, the voice coil is of a flat structure, and a plane where the voice coil lies is perpendicular to the plane where the vibrating diaphragm lies; the magnetic circuit system comprises magnets, and a plane where the magnets lie is parallel to the plane where the voice coil lies; the vibration sound-generating device further comprises a mass block and an elastic support, and the elastic support suspends the mass block and the magnets in the housing; and the elastic support is an annular structure, the mass block and the magnets are located inside the elastic support, two opposed sides of the elastic support are fixedly connected with the magnets, and the other two sides of the elastic support are fixed on the housing.

11 Claims, 4 Drawing Sheets

(58) Field of Classification Search
USPC ..... 381/396, 398, 400, 409, 408, 407, 150
See application file for complete search history.

VIBRATION SOUND-GENERATING DEVICE

TECHNICAL FIELD

The present disclosure relates to the technical field of electro acoustic products, and particularly to a vibration sound-generating device in a portable electronic apparatus.

BACKGROUND

Vibration sound generating devices are multi-functional acoustic devices and have the function of a vibration motor in addition to the vibration sound-generating function of an ordinary speaker. Vibration sound-generating devices, by combining the functions of two important components (speaker and vibration motor) in the original portable electronic apparatuses, not only simplify the assembling process of portable electronic apparatuses, but also effectively save the internal space of portable electronic apparatuses and reduce the production costs of portable electronic apparatuses. Hence, the vibration sound-generating device simultaneously having sound-generating function and vibration function is applied to the field of portable electronic apparatuses more and more extensively.

At present, the vibration sound-generating device applied to portable electronic apparatuses comprises a vibration system and a magnetic circuit system. The vibration system comprises a vibrating diaphragm and a barrel-shaped voice coil integrally engaged with vibrating diaphragm. The magnetic circuit system comprises a magnet and a magnetic gap, and the barrel-shaped voice coil is disposed in the magnetic gap. When the vibration sound-generating device operates, the barrel-shaped voice coil, upon the reception of the action of Lorentz force, vibrates in the vertical direction and hereby drives a vibrating diaphragm to vibrate and generate a sound in the vertical direction, and the magnetic circuit system receives a reacting force, generates resonance in the vertical direction and thereby implements the sound-generating function and vibration function. Since the barrel-shaped voice coil occupies a large space and meanwhile requires the magnetic circuit system to reserve the magnetic gap for it and further requires to reserve a vibration space in the vertical direction, the current vibration sound-generating devices all have a large thickness and cannot satisfy the development requirements for slimness and miniaturization of portable electronic apparatuses. Meanwhile, due to existence of the magnetic gap, the size of the magnet is made small, so the magnetic field intensity is made small and the Lorentz force received by the voice coil in the magnetic field is made small, and thereby that causes a low acoustic sensitivity of the vibration sound-generating device, and a weak vibration feeling and an undesirable overall performance. That is very difficult to satisfy people's higher and higher consumption demands for portable electronic apparatuses. Furthermore, the current vibration sound-generating devices are complicated in structure, difficult to assemble and lower in production efficiency.

SUMMARY

In view of the above defects, the technical problem to be solved by the present disclosure is to provide a vibration sound-generating device which exhibits a small thickness, good performance, easy assembling and high production efficiency.

To solve the above technical problems, the present disclosure employs the following technical solutions:

A vibration sound-generating device comprises a housing and a vibration system and a magnetic circuit system received in the housing, a sound exit hole being provided on a side surface of the housing, wherein the vibration system comprises a vibrating diaphragm, a voice coil and a voice coil framework for connecting the vibrating diaphragm with the voice coil, and a plane where the vibrating diaphragm lies is parallel to a side surface where the sound exit hole lies; and the voice coil is of a flat structure, and a plane where the voice coil lies is perpendicular to the plane where the vibrating diaphragm lies; the magnetic circuit system comprises magnets, and a plane where the magnets lie is parallel to the plane where the voice coil lies; the vibration sound-generating device further comprises a mass block and an elastic support, the magnets and the mass block are fixed as an integral structure, and the elastic support suspends the mass block and the magnets in the housing; and the elastic support is an annular structure, the mass block and the magnets are located inside the elastic support, two opposed sides of the elastic support are fixedly connected with the magnets, an extension direction of the two sides is perpendicular to a vibration direction of the mass block and the magnets, and the other two sides of the elastic support are fixed on the housing.

Preferably, a position where the elastic support is fixedly connected with the magnets is located at a central location of the two sides, and a spacing between the two sides at the central location is smaller than a spacing between their two ends.

Preferably, two adjacent sides of the elastic support are connected via an arcuate transition.

Preferably, a pallet is provided between central locations of two sides where the elastic support is fixedly connected with the magnets, and two ends of the pallet are individually fixedly connected with lower edges of the two sides.

Preferably, the elastic support is comprised of two elastic sheets of identical structure, the two elastic sheets are disposed symmetrically and connected as one piece via the pallet, and an external shape of the elastic support is approximately two M shapes snap-fitted to each other.

Preferably, a positioning slot is disposed at a location underside the mass block corresponding to the pallet, and the pallet is snap-fitted in the positioning slot.

Preferably, the voice coil framework is a sheet-shaped structure, the voice coil is fixed on the voice coil framework, the vibrating diaphragm is provided with an insertion boss protruding towards the voice coil, the insertion boss is provided with a receptacle orifice, and an end of the voice coil framework is inserted and fixed in the receptacle orifice.

Preferably, the housing comprises an upper housing and a lower housing, the upper housing and one side of the lower housing are connected into one piece via a side cover, and the sound exit hole is disposed on the side cover; and the vibrating diaphragm comprises a bent ring portion engaged with the side cover by injection molding and a reinforcing portion fixed in the middle of the bent ring portion, and the insertion boss is located on the reinforcing portion.

Preferably, the voice coil framework comprises two sheets of the framework which are identically structured and disposed symmetrically, and both ends of the voice coil are respectively fixed on the two sheets of the framework; and the two sheets of the framework are both printed with a circuit, one end of each of the two sheets of the framework is fixed with the vibrating diaphragm in a plugged manner, the other end is provided with a connecting portion electrically connected with an external circuit, a fixing portion for fixing the voice coil is connected with the plugged connection end, and the fixing portion is connected with the connecting portion via an elastic connecting arm.

Preferably, the magnets comprise two magnets, the mass block located between the two magnets is provided with a limiting raised ridge for isolating the two magnets, and an extension direction of the limiting raised ridge is perpendicular to its vibration direction; and the position on the mass block where the limiting raised ridge is provided protrudes out of both ends of the mass block in an extension direction of the limiting raised ridge, and a limiting block for preventing the magnets and the mass block from rising is disposed above the protruding positions corresponding to the two ends of the mass block.

Preferably, a hollow-out is provided at an arcuate transition connection between two adjacent sides of the elastic support.

By employing the above technical solutions, the present disclosure achieves the following advantageous effects:

Of the present disclosure, the sound exit hole of the vibration sound-generating device is disposed on the side surface, the plane where the vibrating diaphragm lies is parallel to the side surface where the sound exit hole lies, the voice coil is of a flat structure, and the plane where the voice coil lies is perpendicular to the plane where the vibrating diaphragm lie. The plane where the magnets lie is parallel to the plane where the voice coil lies. The vibration sound-generating device further comprises a mass block and an elastic support, the magnets and the mass block are fixed as an integral structure, and the elastic support suspends the mass block and the magnets in the housing. The two sides where the extension direction of the elastic support is perpendicular to the vibration direction are fixed with the magnets, and the other two sides are fixed on the housing. When alternating current is introduced into the voice coil, the voice coil receives the Lorentz force in the horizontal direction in the magnetic field generated by the magnets, thereby the voice coil vibrates in the horizontal direction and the voice coil framework drives the vibrating diaphragm to generate a sound. According to the acting force-reacting force principle of the magnetic field, the magnets receive an acting force in the opposite direction in the same magnitude. Within certain frequencies, the magnets and the mass block jointly vibrate reciprocatingly in the horizontal direction, thereby achieving the vibration function of the vibration sound-generating device. Based on the above structure of the vibration sound-generating device and the working principle of vibration in the horizontal direction of the present disclosure, the vibration sound-generating device of the present disclosure has the following advantages as compared with the vibration sound-generating device which vibrates in the vertical direction in the prior art:

1) The vibration sound-generating device of the present invention has a small thickness and can satisfy the slimness-oriented development requirement of portable electronic apparatuses;

2) The sizes of magnets are large, the magnetic field intensity is large, the acoustic flexibility is high, the vibration feeling is strong, the overall use performance is good, which can satisfy people's increasing consumption demands;

3) The vibration sound-generating device of the present disclosure can avoid the obstruction of the sound exit hole and ensure the sound exit effect when the portable electronic apparatus does not have a sufficient thickness; and 4) The magnets and the mass block are fixed with the housing via the elastic support, so the assembling process is simple and the production efficiency is high.

As a position where the elastic support is fixedly connected with the magnets is located at a central location of the two sides, a spacing between the two sides at the central location is smaller than a spacing between their two ends. That is, the elastic support has a narrowed middle portion, which design facilitates the increase of the compliance of the elastic support and the decrease of the resonance frequency of the vibration sound-generating device.

Since there is an arcuate transition connection between the two adjacent sides of the elastic support, that is, the four corners of the elastic support all are arcuate bends, that can effectively control most of the x-direction vibration of the magnetic circuit within a linear region, and provide an x-axis restoration force with excellent symmetry when the magnetic circuit vibrates.

Since the pallet is disposed between the central locations of the two sides where the elastic support is fixedly connected with the magnets, two ends of the pallet are individually fixedly connected with lower edges of the two sides. The pallet functions to support the magnets and the mass block, which may effectively prevent the disengagement of the magnets and the mass block from the elastic support, improve the reliability of the vibration sound-generating device and effectively prolongs the service life of the vibration sound-generating device.

Since a positioning slot is disposed at a location underside the mass block corresponding to the pallet, and the pallet is snap-fitted in the positioning slot. The positioning slot functions for positioning purpose, and upon assembling, can effectively reduce the assembling difficulty and improve the assembling efficiency, and meanwhile can ensure the uniformity of products and improve the qualification rate of finished products.

Since a hollow-out is provided at each arcuate transition connection between two adjacent sides of the elastic support, that is, a hollow-out is provided at four corners of the elastic support, the solution can further boost the compliance of the elastic support and reduce the resonance frequency of the vibration sound-generating device.

To conclude, the vibration sound-generating device of the present disclosure solves the technical problems that the vibration sound-generating devices in the prior art have large thickness, large assembling difficulty and undesirable performance. The vibration sound-generating device of the present disclosure has advantages such as small thickness, good performance, simple structure, easy assembling and high production efficiency.

The above depictions are only generalization of technical solutions of the present disclosure. Specific embodiments of the present disclosure are presented below to make the technical means of the present disclosure clearer.

BRIEF DESCRIPTION OF THE DRAWINGS

The drawings are used to provide further understanding of the present disclosure, constitute part of the description, illustrate the present disclosure together with the embodiments of the present disclosure, and do not constitute limitation of the present disclosure. In the drawings.

In the figures: the reference number 10 denotes upper housing, 100 damping hole, 102 notch, 12 lower housing, 14 side cover, 140 sound exit hole, 16 fixing member, 160 positioning post, 162 boss, 164 connecting member, 18 side frame, 20 anti-dust mesh, 22 damping mesh, 24 elastic pad, 30 reinforcing portion, 300 insertion boss, 302 receptacle orifice, 32 voice coil framework, 320 plug portion, 322 fixing portion, 3220 through hole, 324 connecting arm, 326 connecting portion, 3260 positioning aperture, 328 welding pad, 34 voice coil, 36 bent ring portion, 40 magnet, 42 mass block, 40 positioning slot, 422 limiting raised ridge, 424 protrusion, 44 limiting block, 440 engaging portion, 442 limiting portion, 46 elastic support, 460 first fixing portion, 426 second fixing portion, 464 pallet, 466*a* bent portion, 466*b* bent portion, 4660 hollow-out.

DETAILED DESCRIPTION

The present disclosure will be further illustrated with reference to the figures and the embodiments.

The orientation "upper" involved in the description refers to the direction of the vibration system, and the orientation "lower" refers to the direction of the magnetic circuit system. The "inside" involved in the description refers to the side adjacent to the center of the vibration sound-generating device, and the "outside" refers to the side away from the center.

Embodiment 1

Figure 1:
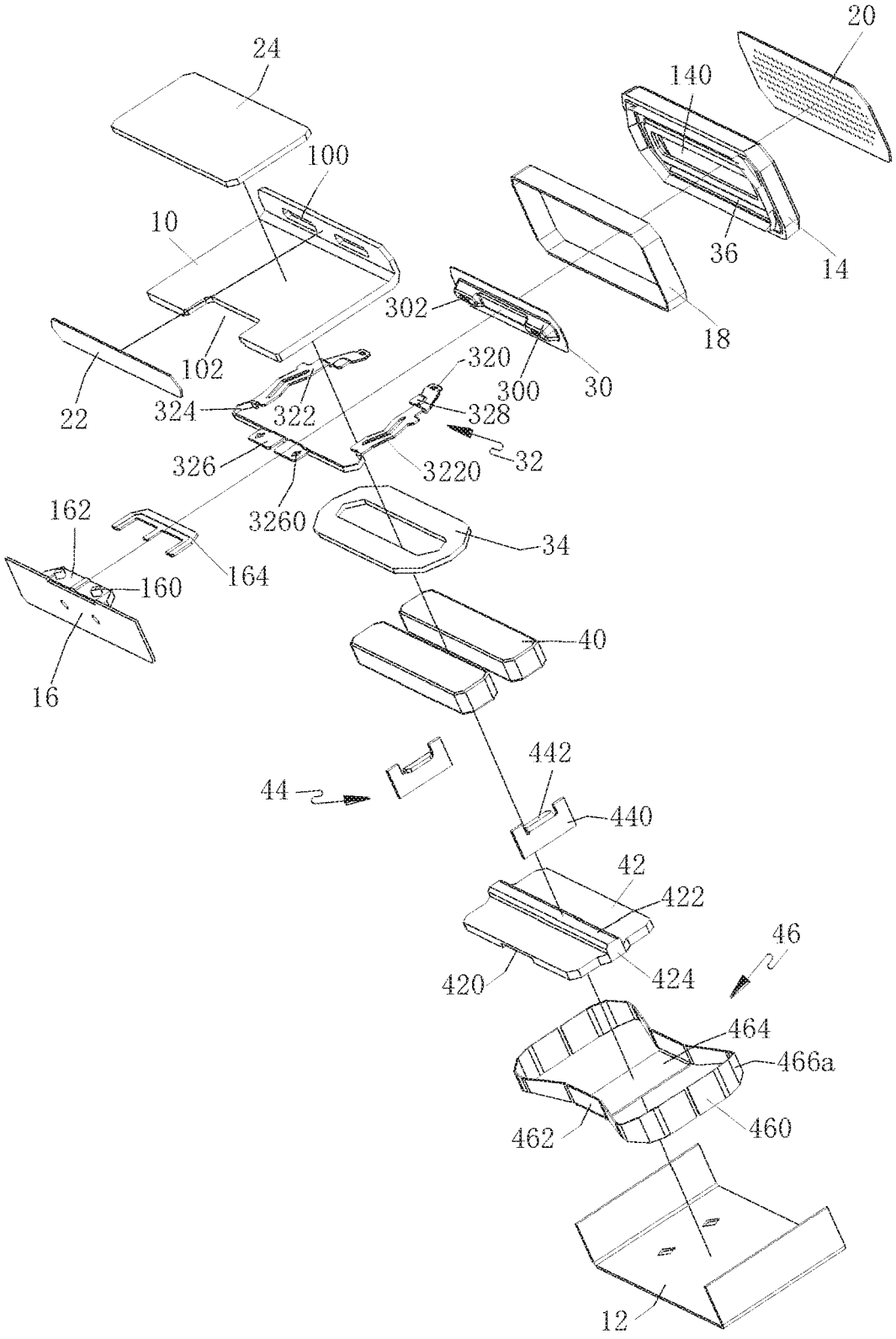
FIG. 1 is an exploded view of Embodiment 1 of a vibration sound-generating device according to the present disclosure.
Figure 2:
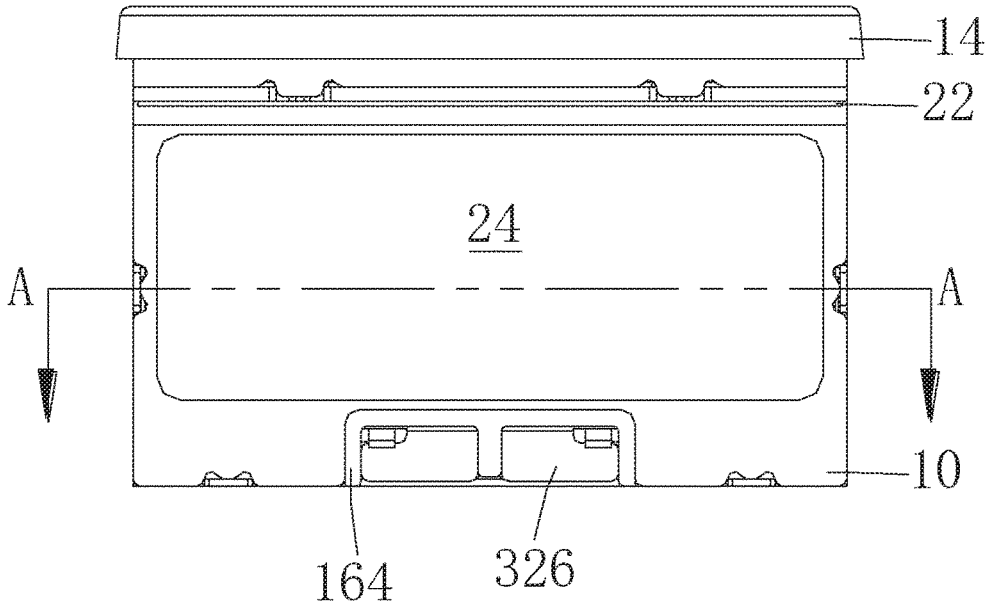
FIG. 2 is a combination view of FIG. 1.
Figure 3:
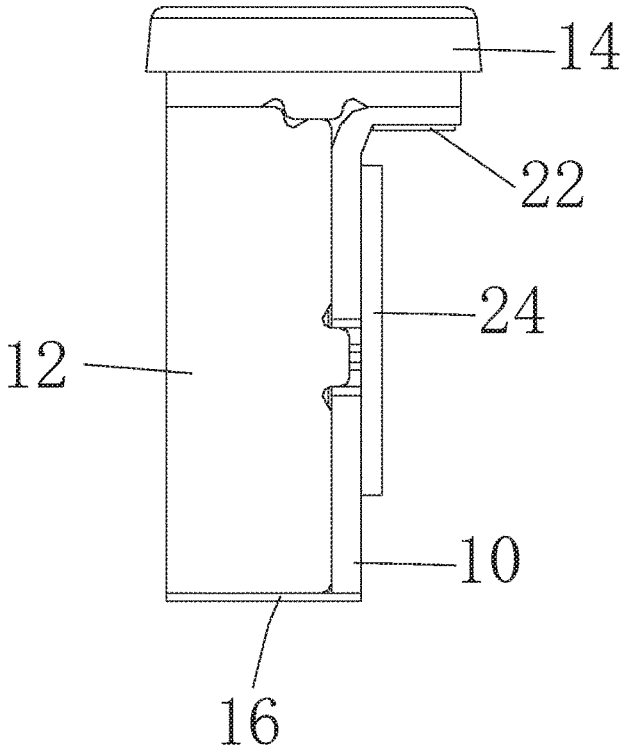
FIG. 3 is a left view of FIG. 2.

As jointly shown in FIG. 1, FIG. 2 and FIG. 3, a vibration sound-generating device comprises a housing comprised of an upper housing 10, a lower housing 12 and a side cover 14 which are engaged together, the lower housing 12 is a rectangular structure, a sidewall is vertically provided at an edge position of each of its two opposed short sides, the upper housing 10 is snap-fitted on the two sidewalls, a long side on one side of the lower housing 12 is engaged with the upper housing 10 via the side cover 14, the other long side on the other side is engaged with a fixing member 16, the fixing member 16 is used to fix a voice coil framework 32 of the vibration system, and the sidewall on the side of the housing is formed here. A vibration system and a magnetic circuit system are received in the housing, a sound exit hole 140 is disposed in the middle of the side cover 14, and the outside of the sound exit hole 140 is covered by an anti-dust mesh 20. The side of the upper housing 10 engaged with the side cover 14 is bent vertically upwardly, a damping hole 100 is disposed on the upwardly bent portion, and a damping mesh 22 covers the outside of the damping hole 100. The side cover 14 is simultaneously snap-fitted on the upwardly bent portion and the outer periphery of the lateral edge of the lower housing 12 so that the whole vibration sound-generating device is L-shaped as viewed from the side surface.

Figure 7:
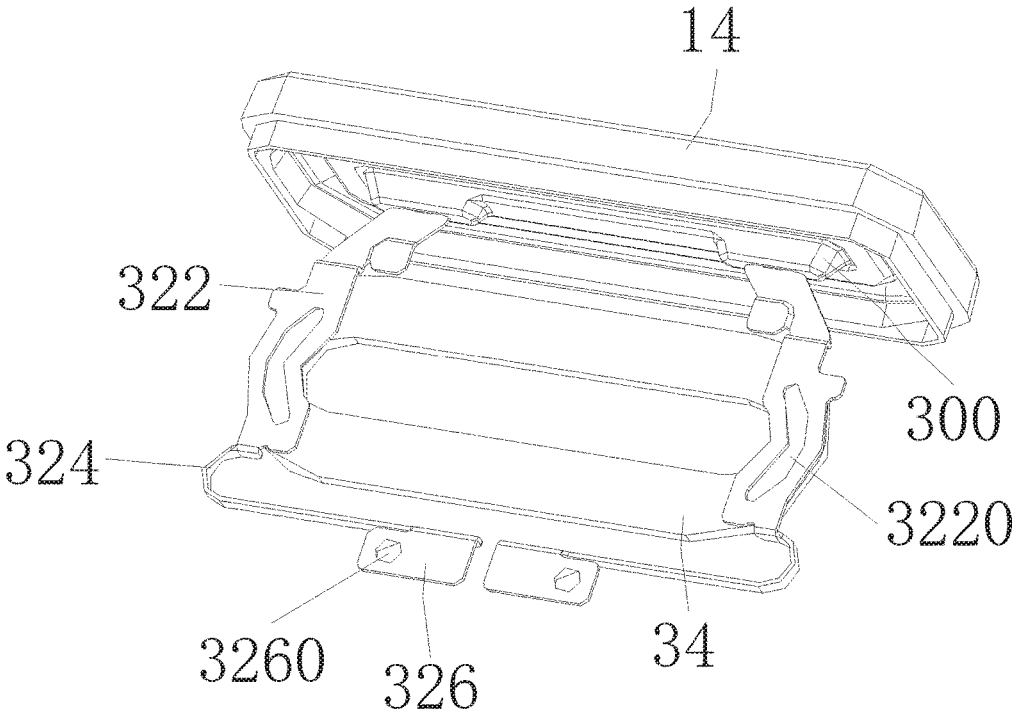
FIG. 7 is a combination view of the vibration system in FIG. 1.

As jointly shown in FIG. 1, FIG. 2 and FIG. 7, the vibration system comprises a vibrating diaphragm, a voice coil 34 and a voice coil framework 32 for connecting the vibrating diaphragm with the voice coil 34. The plane where the vibrating diaphragm lies is parallel to the side surface where the sound exit hole 140 lies, and it includes a bent ring portion 36 engaged with the side cover 14 by injection molding and a reinforcing portion 30 engaged at a central location of the bent ring portion 36. In the present embodiment, preferably the side cover 14 and the bent ring portion 36 are an integral structure and made of the same material, that is, silica gel, the reinforcing portion 30 is engaged with the bent ring portion 36 by injection molding, a hard side frame 18 is engaged inside the side cover 14, and the side frame 18 is engaged with the upper housing 10 and the lower housing 12. The voice coil 34 is a runway-shaped flat structure, and the plane where the voice coil 34 lies is perpendicular to the plane where the vibrating diaphragm lies. The voice coil framework 32 is sheet-shaped and comprises two sheets of the framework which are identically structured and disposed symmetrically, and the two sheets of the voice coil framework 32 are both L-shaped and take an approximately U shape when they are engaged with each other. A connecting portion 326 is disposed at the joined ends of the two sheets of the voice coil framework 32, the connecting portion 326 is fixed on a fixing member 16, and the connecting portion 326 is connected with an elastic connecting arm 324. In the case that that the connecting portion 326 is fixed on the fixing member 16, the connecting arm 324 may provide a vibration telescoping amount for the horizontal vibration of the voice coil 34. The connecting arm 324 is connected with a fixing portion 322, the fixing portion 322 is connected with a plug portion 320, and the plug portion 320 is connected with the reinforcing portion 30. The bent portions at both ends of the voice coil 34 are respectively fixed at the fixing portions 322 of the two sheets of the voice coil framework 32, with the straight sides on its both ends being parallel to the vibrating diaphragm, that is, the extension direction of the straight sides on both sides is perpendicular to its vibration direction.

Figure 4:
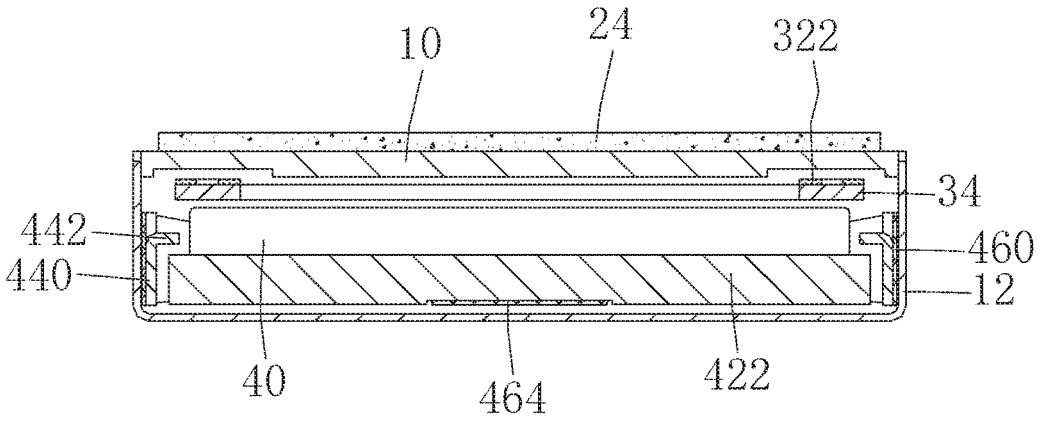
FIG. 4 is a sectional view of FIG. 2 taken along line A-A.

As jointly shown in FIG. 1 and FIG. 4, the reinforcing portion 30 is provided with an insertion boss 300 protruding towards the voice coil 34, an end face of the insertion boss 300 is provided with a receptacle orifice 302, the receptacle orifice 302 is sized and shaped to adapt for the plug portion 320 of the voice coil framework 32, the plug portion 320 is inserted and fixed in the receptacle orifice 302 to thereby implement the fixed connection of the voice coil 34 and the vibrating diaphragm. When the voice coil 34 vibrates, it drives the vibrating diaphragm to vibrate and generate a sound, and the sound generated from the vibration of the vibrating diaphragm is transmitted out of the sound exit hole 140.

As jointly shown in FIG. 1 and FIG. 2, the two sheets of the voice coil framework 32 are both printed with a circuit, a welding pad 328 for electrically connecting a lead wire of the voice coil 34 is disposed between the fixing portion 322 and the plug portion 320, the connecting portion 326 is provided with an external welding pad electrically connected with an external circuit, and the connecting portion 326 is further provided with a positioning aperture 3260. A boss 162 perpendicular to the fixing member 16 is disposed inside the fixing member 16, the boss 162 is provided with a positioning post 160 respectively at the locations corresponding to the two positioning apertures 3260, the voice coil framework 32 is fixed on the fixing member 16 via the cooperation between the positioning post 160 and the positioning aperture 3260. A notch 102 is provided at a location on the upper housing 10 corresponding to the boss 162 so that the external welding pad of the connecting portion 326 is exposed external of the housing for easy electrical connection with the external circuit. The upper housing 10 and the boss 162 are sealed by an M-shaped seal 164 therebetween.

As jointly shown in FIG. 1 and FIG. 7, the fixing portions 322 of the two sheets of the voice coil framework 32 are a strip-shaped and sheet-shaped structure, and the two fixing portions 322 are both provided with an elongate through hole 3220 whose extension direction is the same as the extension direction of the fixing portion 322. The arrangement of the through holes 3220, without affecting the firmness of the voice coil 34, effectively reduces the weight of the voice coil framework 32 and thereby can effectively boost the sensitivity of the vibration sound-generating device.

Figure 5:
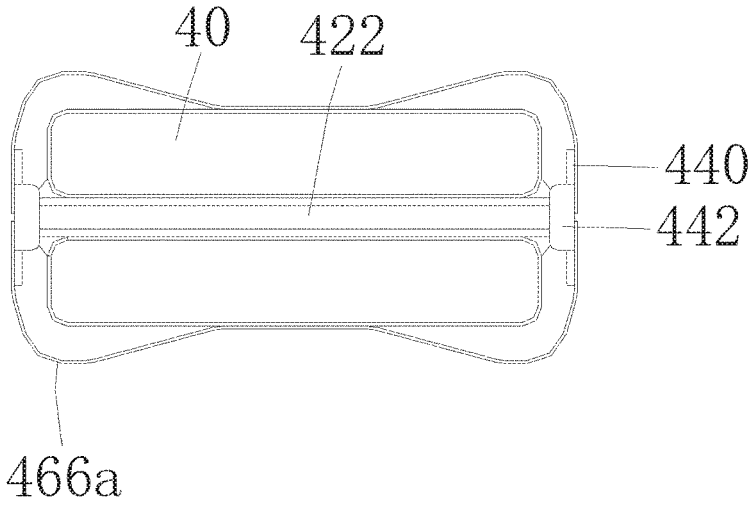
FIG. 5 is a combination view of the magnetic circuit system in FIG. 1.

As jointly shown in FIG. 1 and FIG. 5, the magnetic circuit system comprises two bar-shaped magnets 40 with opposite polarities, the plane where the two magnets 40 lie is parallel to the plane where the voice coil 34 lies, and the extension direction of the two magnets 40 is consistent with the extension direction of the straight sides of the voice coil 34. The two magnets 40 are fixed on a mass block 42 side by side, the mass block 42 is rectangular, and the extension direction of its long sides is consistent with the extension direction of the magnets 40. At a location on the mass block 42 corresponding to the middle of the two magnets 40 is provided a limiting raised ridge 422 for preventing the two magnets 40 from attracting each other, the extension direction of the limiting raised ridge 422 is the same as the extension direction of the magnets 40, that is, perpendicular to its vibration direction. The magnets 40 and the mass block 42 are fixed as an integral structure which is suspended in the housing via an elastic support 46.

As jointly shown in FIG. 1 and FIG. 5, the elastic support 46 is an annular structure and comprised of two elastic sheets of identical structure, the two elastic sheets are disposed symmetrically, and the magnets 40 and the mass block 42 are fixed inside the elastic support 46. The middle portions of the long sides on the two opposed sides of the elastic support 46 are respectively fixedly connected with the sides of the two magnets 40, and the extension direction of the sides on both sides is perpendicular to the vibration direction of the mass block 42 and the magnets 40; and the short sides on both sides of the elastic support 46 are fixedly connected with the sidewalls on both sides of the lower housing 12, and the extension direction of the sides on both sides is parallel to the vibration direction of the mass block 42 and the magnets 40. Both ends of the two elastic sheets are provided with a first fixing portion 460 fixedly connected with the lower housing 12, the central locations of the two elastic sheets both are a second fixing portion 462 fixedly connected with the magnets 40, the first fixing portion 460 is connected with the second fixing portion 462 via a bent portion 466*a* in between, first fixing portions at the same ends of the two elastic sheets are docked and jointly form a short side on one side of the elastic support 46. The spacing between the two second fixing portions 462 is smaller than the spacing between the bent portions 466*a* at both ends, that is, the center of the elastic support 46 is a narrowed structure. The narrowed structure facilitates the increase of the compliance of the elastic support 46 and the decrease of the resonance frequency. The bent portions 466*a* at the four corners all are arcuate transitions, and the external shape of the whole elastic support 46 is approximately two M shapes snap-fitted to each other. The arcuate transition connections at the four corners can provide an x axis restoration force (the direction of the x axis is consistent with the vibration direction) with an excellent symmetry when the magnets vibrate. A pallet 464 is provided between two second fixing portions 462, both ends of the pallet 464 are respectively fixedly connected with the lower edges of the two second fixing portions 462, and the width of the pallet 464 is consistent with the length of the second fixing portion 462. The two M-shaped elastic sheets are connected into one piece via the pallet 464. The pallet 464 may effectively prevent the disengagement of the magnets 40 and the mass block 42 from the elastic support 46, improves the reliability of the vibration sound-generating device and effectively prolongs the service life of the vibration sound-generating device.

Figure 6:
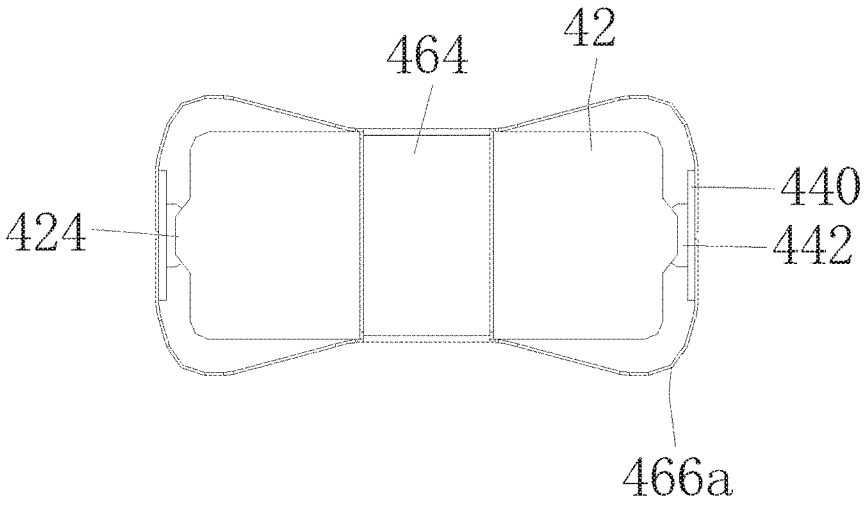
FIG. 6 is a rear view of FIG. 5.

As jointly shown in FIG. 1, FIG. 4 and FIG. 6, a positioning slot 420 is disposed at a location underside the mass block 42 corresponding to the pallet 464, and the pallet 464 is snap-fitted in the positioning slot 420. Upon assembling, operators can fix the magnets 40 and the mass block 42 accurately on the elastic support 46 for positioning purpose, thereby simplifying the assembling difficulty and boosting uniformity and qualification rate of finished products.

As jointly shown in FIG. 1, FIG. 4, FIG. 5 and FIG. 6, in the present embedment preferably the upper housing 10 is made of a metallic material having a magnetic conduction function and may optimize the distribution of magnetic field, but attracts with the magnets 40 so that the magnets 40 and the mass block 42 rise. To prevent the magnets 40 and mass block 42 from rising, two protrusions 424 are formed at both ends protruding out of the mass block 42 in the extension direction of the limiting raised ridge 422 (that is, the direction perpendicular to the vibration direction) at a location on the mass block 42 where the limiting raised ridge 422 is provided. A limiting block 44 is fixed respectively at the locations of the inside of the elastic support 46 corresponding to the two protrusions 424, that is, the two limiting blocks 44 are respectively fixed at a central location of the inside of the two short sides on both sides of the elastic support 46, i.e., fixed on the lower housing 12. The limiting block 44 comprises an engaging portion 440 fixed to the elastic support 46, the engaging portion 440 is disposed vertically and clings to an inside wall of the elastic support 46, the central location of the upper end of the engaging portion 440 is bent inwardly to form a limiting portion 442 perpendicular to the engaging portion 440, and the limiting portion 442 is disposed horizontally above the protrusions 424. The limiting block 44 may effectively prevent the magnets 40 and the mass block 42 from rising, and ensure the performance and normal operation of the vibration sound-generating device while optimizing the distribution of magnetic field and increasing the force received by the voice coil 34 in magnetic field.

As jointly shown in FIG. 1, FIG. 2, FIG. 3 and FIG. 4, since the upper housing 10 is made of a metallic material, an elastic pad 24 is stuck on the upper housing 10 to ensure the tight engagement of the vibration sound-generating device and a portable electronic apparatus. The elastic pad 24 may improve the tight engagement between the vibration sound-generating device and a portable electronic apparatus, and meanwhile may protect the upper housing 10 from extrusion and deformation and play a buffering role.

Embodiment 2

Figure 8:
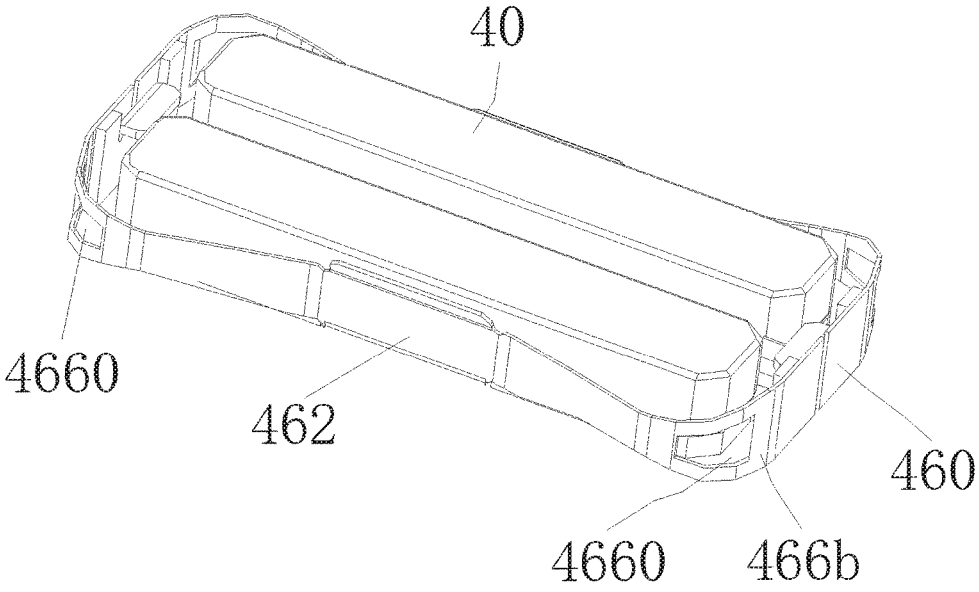
FIG. 8 is a combination view of a magnetic circuit system in Embodiment 2 of the vibration sound-generating device of the present disclosure.

The present embodiment is substantially identical with Embodiment 1, and differs from Embodiment 1 as follows:

As shown in FIG. 8, a hollow-out 4660 is provided on the bent portion 466*b* of the elastic support, i.e., an opening extending in the curve direction of the bent portion 466*b* is provided at each of the four bent portions 466*b*. The arrangement of the hollow-out 4660 may further improve the compliance of the elastic support and reduce the resonance frequency of the vibration sound-generating device.

As shown in FIG. 1, the working principle of the vibration sound-generating device of the present disclosure is as follows:

When alternating current is introduced into the voice coil 34, the voice coil 34 is subjected to the action of Lorentz force in the magnetic field generated by the magnets 40. The magnetic lines of force generated by the magnets 40 perpendicularly pass through the voice coil 34. The voice coil 34 receives the Lorentz force in the horizontal direction according to the left-hand rule, and the voice coil 34 will vibrate in the horizontal direction and drive the vibrating diaphragm to vibrate and generate a sound. According to the acting force-reacting force principle, the magnets 40 receive an acting force in the opposite direction. Since the magnets 40 and the mass block 42 are suspended in the housing via the elastic support, when the voice coil 34 vibrates in the horizontal direction, the magnets 40 and the mass block 42 also vibrate in the horizontal direction and thereby perform the vibrating function.

With the voice coil in the conventional vibration sound-generating device being changed to a flat voice coil, and the conventional vibration in the vertical direction being changed to the vibration in the horizontal direction, the vibration sound-generating device of the present disclosure has advantages such as small thickness, good performance, simple structure, easy assembling and high production efficiency while achieving the sound-generation and vibration functions.

The naming of the first fixing portion and the second fixing portion involved in the description is only intended to distinguish the technical features and does not represent the positional relationship, assembling order and working order of the two.

The present disclosure is not limited to the above specific embodiments. Diverse variations made by those having ordinary skill in the art from the above concept without making any inventive efforts all fall within the protection scope of the present disclosure.

The invention claimed is:

1. A vibration sound-generating device, comprising a housing and a vibration system and a magnetic circuit system received in the housing, a sound exit hole being provided on a side surface of the housing, wherein the vibration system comprises a vibrating diaphragm, a voice coil and a voice coil framework for connecting the vibrating diaphragm with the voice coil, and a plane where the vibrating diaphragm lies is parallel to a side surface where the sound exit hole lies; and the voice coil is of a flat structure, and a plane where the voice coil lies is perpendicular to the plane where the vibrating diaphragm lies;

the magnetic circuit system comprises magnets, and a plane where the magnets lie is parallel to the plane where the voice coil lies;

the vibration sound-generating device further comprises a mass block and an elastic support, the magnets and the mass block are fixed as an integral structure, and the elastic support suspends the mass block and the magnets in the housing; and the elastic support is an annular structure, the mass block and the magnets are located inside the elastic support, two opposed sides of the elastic support are fixedly connected with the magnets, an extension direction of the two sides is perpendicular to a vibration direction of the mass block and the magnets, and the other two sides of the elastic support are fixed on the housing.

2. The vibration sound-generating device according to claim 1, wherein a position where the elastic support is fixedly connected with the magnets is located at a central location of the two sides, and a spacing between the two sides at the central location is smaller than a spacing between their two ends.

3. The vibration sound-generating device according to claim 2, wherein two adjacent sides of the elastic support are connected via an arcuate transition.

4. The vibration sound-generating device according to claim 3, wherein a pallet is provided between central locations of two sides where the elastic support is fixedly connected with the magnets, and two ends of the pallet are individually fixedly connected with lower edges of the two sides.

5. The vibration sound-generating device according to claim 4, wherein the elastic support is comprised of two elastic sheets of identical structure, the two elastic sheets are disposed symmetrically and connected as one piece via the pallet; and an external shape of the elastic support is approximately two M shapes snap-fitted to each other.

6. The vibration sound-generating device according to claim 4, wherein a positioning slot is disposed at a location underside the mass block corresponding to the pallet, and the pallet is snap-fitted in the positioning slot.

7. The vibration sound-generating device according to claim 4, wherein the voice coil framework is a sheet-shaped structure, the voice coil is fixed on the voice coil framework, the vibrating diaphragm is provided with an insertion boss protruding towards the voice coil, the insertion boss is provided with a receptacle orifice, and an end of the voice coil framework is inserted and fixed in the receptacle orifice.

8. The vibration sound-generating device according to claim 7, wherein the housing comprises an upper housing and a lower housing, the upper housing and one side of the lower housing are connected into one piece via a side cover, and the sound exit hole is disposed on the side cover; and the vibrating diaphragm comprises a bent ring portion engaged with the side cover by injection molding and a reinforcing portion fixed in the middle of the bent ring portion, and the insertion boss is located on the reinforcing portion.

9. The vibration sound-generating device according to claim 7, wherein the voice coil framework comprises two sheets of the framework which are identically structured and disposed symmetrically, and both ends of the voice coil are respectively fixed on the two sheets of the framework; and the two sheets of the framework are both printed with a circuit, one end of each of the two sheets of the framework is fixed with the vibrating diaphragm in a plugged manner, the other end is provided with a connecting portion electrically connected with an external circuit, a fixing portion for fixing the voice coil is connected with the plugged connection end, and the fixing portion is connected with the connecting portion via an elastic connecting arm.

10. The vibration sound-generating device according to claim 4, wherein the magnets comprise two magnets, the mass block located between the two magnets is provided with a limiting raised ridge for isolating the two magnets, and an extension direction of the limiting raised ridge is perpendicular to its vibration direction; and the position on the mass block where the limiting raised ridge is provided protrudes out of both ends of the mass block in an extension direction of the limiting raised ridge, and a limiting block for preventing the magnets and the mass block from rising is disposed above the protruding positions corresponding to the two ends of the mass block.

11. The vibration sound-generating device according to claim 4, wherein, a hollow-out is provided at an arcuate transition connection between two adjacent sides of the elastic support.

* * * * *